US010605572B1

(12) United States Patent
Bartoszewicz

(10) Patent No.: US 10,605,572 B1
(45) Date of Patent: Mar. 31, 2020

(54) SYSTEM AND APPARATUS FOR A FIREARM ACCESSORY MOUNT

(71) Applicant: SCALARWORKS, LLC, Easton, PA (US)

(72) Inventor: Philippe Bartoszewicz, South Orange, NJ (US)

(73) Assignee: SCALARWORKS, LLC, South Orange, NJ (US)

( * ) Notice: Subject to any disclaimer, the term of this patent is extended or adjusted under 35 U.S.C. 154(b) by 0 days.

(21) Appl. No.: 15/928,592

(22) Filed: Mar. 22, 2018

(51) Int. Cl.
*F41G 11/00* (2006.01)
*F41A 3/66* (2006.01)

(52) U.S. Cl.
CPC ..... *F41G 11/003* (2013.01); *F41A 3/66* (2013.01)

(58) Field of Classification Search
CPC ... F41G 1/16; F41G 1/38; F41G 1/387; F41G 1/393; F41G 1/40; F41G 1/41; F41G 11/001; F41G 11/002; F41G 11/003; F41G 11/005
USPC ..... 42/90
See application file for complete search history.

(56) References Cited

U.S. PATENT DOCUMENTS 4,341,022 A * 7/1982 Santoro ..... F41G 11/001 42/124
6,678,988 B1 * 1/2004 Poff, Jr. ..... F41G 11/002 42/124
2011/0296731 A1 * 12/2011 Carlson ..... F41G 11/001 42/90
2015/0219422 A1 * 8/2015 Kincel ..... F41G 11/003 29/525.11
2016/0169610 A1 * 6/2016 Hines ..... F41C 27/00 42/90
2016/0349011 A1 * 12/2016 Jen ..... F41G 11/001

* cited by examiner

*Primary Examiner* — Bret Hayes
(74) *Attorney, Agent, or Firm* — Eversheds Sutherland (US) LLP

(57) ABSTRACT

A firearm accessory mount can be configured to mount a firearm accessory to a firearm. The firearm accessory mount can include a top side, an opposing bottom side, and multiple through holes. The top side can include one or more alignment pins for aligning a firearm accessory. The bottom side can include a first set of elongated slots and a second set of elongated slots. T-slot threaded fasteners can be threadably coupled to a firearm. A portion of each T-slot threaded fastener can be slidably received into a corresponding one of the first and second sets of elongated slots. Threaded fasteners can be positioned through one of the multiple apertures and threadably coupled to the firearm to further couple the firearm accessory mount to the firearm. Additional threaded fasteners can be employed to threadably couple the firearm accessory to the firearm accessory mount.

19 Claims, 8 Drawing Sheets

SYSTEM AND APPARATUS FOR A FIREARM ACCESSORY MOUNT

TECHNICAL FIELD

The present disclosure relates generally to firearms. More particularly, the present disclosure relates to firearm rails that provide for a firearm accessory mounting system and apparatus.

BACKGROUND

In the present disclosure, where a document, an act and/or an item of knowledge is referred to and/or discussed, then such reference and/or discussion is not an admission that the document, the act and/or the item of knowledge and/or any combination thereof was at the priority date, publicly available, known to the public, part of common general knowledge and/or otherwise constitutes prior art under the applicable statutory provisions; and/or is known to be relevant to an attempt to solve any problem with which the present disclosure is concerned with. Further, nothing is disclaimed.

A firearm, for example a shotgun, can include multiple threaded holes for securely attaching thereto a standardized elongated rail for securely mounting a firearm capability enhancement accessory, such as an aiming device (e.g., a reflex collimator sight, holographic sight, magnified scope, or other such aiming devices). These conventional rails can have a T-shaped cross-section with a top of the T-shape corresponding to a top of the rail. Furthermore, these conventional rails can be slotted transversely along a length of the rail, allowing for an indexed spacing of the accessory that is attached to the rail. Some examples of conventional rails include MIL-STD-1913 Picatinny, NATO Accessory Rail (STANAG 4694), or a Weaver Rail.

An accessory mount can be used to attach the aiming device to the rail. Typically, the accessory mount includes a multitude of screws or levers for locking the accessory mount onto the transverse slots of the rail.

In one example firearm application, the ergonomics of a shotgun are designed around bead sights, fixed ghost rings, or peep sights that are built into the shotgun. These fixed sights are generally very low to the receiver of the shotgun.

Elongated rails have a minimum height that forces aiming accessories attached to the rails to be positioned at a level higher above the receiver than the conventional shotgun sights. Furthermore, accessory mounts have a minimum base thickness that can further raise the aiming accessory to an even higher level above the receiver. Accordingly, mounting an aiming device by way of an accessory mount on a firearm forces the shooter out of the optimal ergonomic shooting position, which degrades their shooting prowess. Additionally, mounting an aiming device by way of an accessory mount prevents the possibility of co-witnessing fixed ghost rings or adjustable iron sights that are built into the shotgun with the aiming devices. As a result, if the battery or circuitry of the aiming device coupled to the receiver were to fail, the shooter would not be able to use the built-in iron sights provided on the firearm to accurately fire the firearm.

Conventional firearm receivers tend to be made of a thin walled material such as metal (e.g., steel, aluminum, or titanium alloys), polymers, or polymer composites that include rigid threaded inserts that limit the length of the threaded shank of a mounting screw that can be used to attach a standardized elongated rail to the receiver. As a result, in order to better resist side impacts, a larger number of screws is preferable to more securely attach an elongated accessory rail to the firearm receiver.

There also exists dedicated aiming device mounts that have a built-in platform that is specific to a specific type of aiming device which has the advantage of being able to position the aiming device lower to the firearm receiver (e.g., a shotgun receiver) than is otherwise possible using a standardized elongated rail with a separate clamp on mount.

Certain aiming devices, such as the TRIJICON RMR, require that the mounting platform act as a sealing plate for the aiming device. This precludes the possibility of putting fasteners through the mounting platform to more securely attach the mount to the firearm receiver. Other types of aiming devices, such as the AIMPOINT MICRO T-1, T-2, H-1, H-2 and the many clones of these aiming devices, as well as the TRIJICON MRO and any other such aiming devices, require that the fasteners used to attach the aiming device to its mounting platform be inserted from the underside of the mount.

Because of the mounting requirements of these aiming devices, existing dedicated mounts all suffer from not allowing all the available screw holes in a firearm receiver (e.g., a shotgun receiver) to be employed to fasten the mount to the receiver. This puts all the stress on fewer screws and threaded holes which can cause either the screws to fail, or worse yet, the threaded screw holes to fail and compromise the usability of the firearm.

SUMMARY

In an example embodiment, a device can include a firearm accessory mount that includes: a platform structured to support a firearm accessory; one or more protrusions with a plurality of through holes, and one or more key slot holes on the underside of the device. One or more T-slot head screws can be first attached to the firearm receiver and the firearm accessory mount can be placed over these T-slot headed screws by aligning the keyhole external holes to the matching T-slot headed screws. Once the firearm accessory mount is mated to the firearm receiver, the firearm receiver is slid forward or backwards (depending on the orientation of the one or more keyhole slots) with respect to the firearm accessory mount so that the T-slot headed screws are captured vertically by the one or more keyhole slots. The firearm accessory mount can then be secured both vertically and horizontally with one or more externally accessible fasteners. Finally, a firearm accessory, such as a aiming device for the firearm, can be attached to the mounting platform of the firearm accessory mount with a plurality of fasteners.

In an alternative embodiment, a device can include a firearm accessory mount that includes: a platform structured to support a firearm accessory; one or more protrusions with a plurality of through holes, and one or more key slot holes on the underside of the firearm accessory mount. The aiming device or other firearm accessory can be first attached to the mounting platform by way of a plurality of fasteners from the underside of the firearm device mount. One or more T-slot headed screws can be attached to the firearm receiver and the firearm accessory mount can be placed over these screws by aligning the keyhole external holes over the matching T-slot headed screws. Once the firearm device mount is mated to the firearm receiver, the firearm receiver can be slid forward or backwards (depending on the orientation of the one or more keyhole slots) with respect to the firearm accessory mount so that the T-slot headed screws are captured vertically by the one or more keyhole slots. The firearm accessory mount can then be secured both vertically and horizontally with one or more externally accessible fasteners.

BRIEF DESCRIPTION OF THE SEVERAL VIEWS OF THE DRAWINGS

For a more complete understanding of the present disclosure and certain features thereof, reference is now made to the following description, in conjunction with the accompanying figures briefly described as follows.

DETAILED DESCRIPTION OF THE EXAMPLE EMBODIMENTS

Example embodiments of the disclosure now will be described more fully hereinafter with reference to the accompanying drawings, in which example embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like, but not necessarily the same or identical, elements throughout.

Certain dimensions and features of the novel firearm accessory mounting system are described herein using the term "approximately." As used herein, the term "approximately" indicates that each of the described dimensions is not a strict boundary or parameter and does not exclude functionally similar variations therefrom. Unless context or the description indicates otherwise, the use of the term "approximately" in connection with a numerical parameter indicates that the numerical parameter includes variations that, using mathematical and industrial principles accepted in the art (e.g., rounding, measurement or other systematic errors, manufacturing tolerances, etc.), would not vary the least significant digit.

In addition, certain relationships between dimensions of the firearm accessory mounting system described herein and between features of the firearm accessory mounting system are described herein using the term "substantially." As used herein, the terms "substantially" and "substantially equal" indicates that the equal relationship is not a strict relationship and does not exclude functionally similar variations therefrom. Unless context or the description indicates otherwise, the use of the term "substantially" or "substantially equal" in connection with two or more described dimensions or positions indicates that the equal relationship between the dimensions or positions includes variations that, using mathematical and industrial principles accepted in the art (e.g., rounding, measurement or other systematic errors, manufacturing tolerances, etc.), would not vary the least significant digit of the dimensions. As used herein, the term "substantially constant" indicates that the constant relationship is not a strict relationship and does not exclude functionally similar variations therefrom. As used herein, the term "substantially parallel" indicates that the parallel relationship is not a strict relationship and does not exclude functionally similar variations therefrom.

Figure 1:
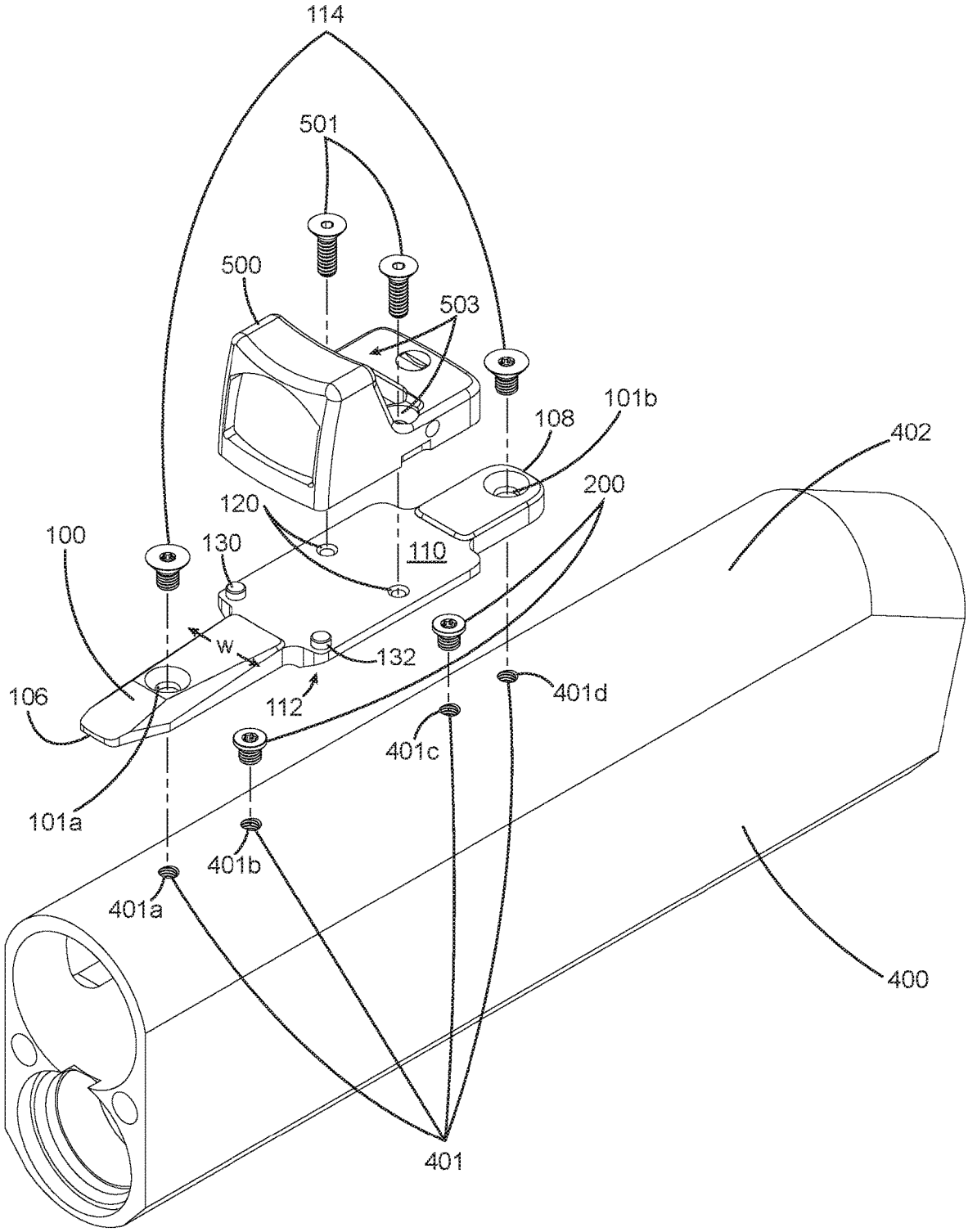
FIG. 1 is a partial exploded view of a firearm and firearm accessory mounting system for coupling a firearm accessory to a firearm in accordance with one example embodiment of the disclosure.

FIG. 1 is a partial exploded view of a firearm and firearm accessory mounting system for coupling a firearm accessory to a firearm in accordance with one example embodiment of the disclosure. Referring now to FIG. 1, the example system can include a firearm. In one example, the firearm can be a shotgun. Alternatively, the firearm can be a rifle, pistol or any other type of firearm known to those of ordinary skill in the art. The firearm can include a firearm receiver 400 or frame. The firearm receiver 400 generally includes the part of a firearm which provides housing for internal components such as the hammer, bolt or breechblock, action and firing mechanism. The firearm receiver 400 can also include the firearm barrel or portion of the barrel through which a projectile (e.g., bullet) is fired.

The firearm receiver 400 can include a top side 402 that extends along a substantial portion of the firearm receiver 400. Multiple firearm receiver threaded apertures 401*a*-401*d*, and described collectively as firearm receiver threaded apertures 401, can be provided along the top side of the firearm receiver 400. For example, the firearm receiver threaded apertures 401 can be drilled and tapped or otherwise machined into the top side 402 of the firearm receiver 400 at the apex or highest point along the top side 402 of the firearm receiver 400. In one example, four firearm receiver threaded apertures 401 are provided along the top side 402 of the firearm receiver 400. However, in other example embodiments, greater or fewer than four firearm receiver threaded apertures 401 can be provided. Each of the firearm receiver threaded apertures 401*a*-401*d* can receive at least partially therein a threaded fastener as described below. The spacing between each firearm receiver threaded aperture 401*a*-401*d* can be constant or variable. In one example, the spacing between firearm receiver threaded aperture 401*a* and firearm receiver threaded aperture 401*b* is equal to or substantially equal to the distance between firearm receiver threaded aperture 401*c* and firearm receiver threaded aperture 401*d*.

Figure 3:
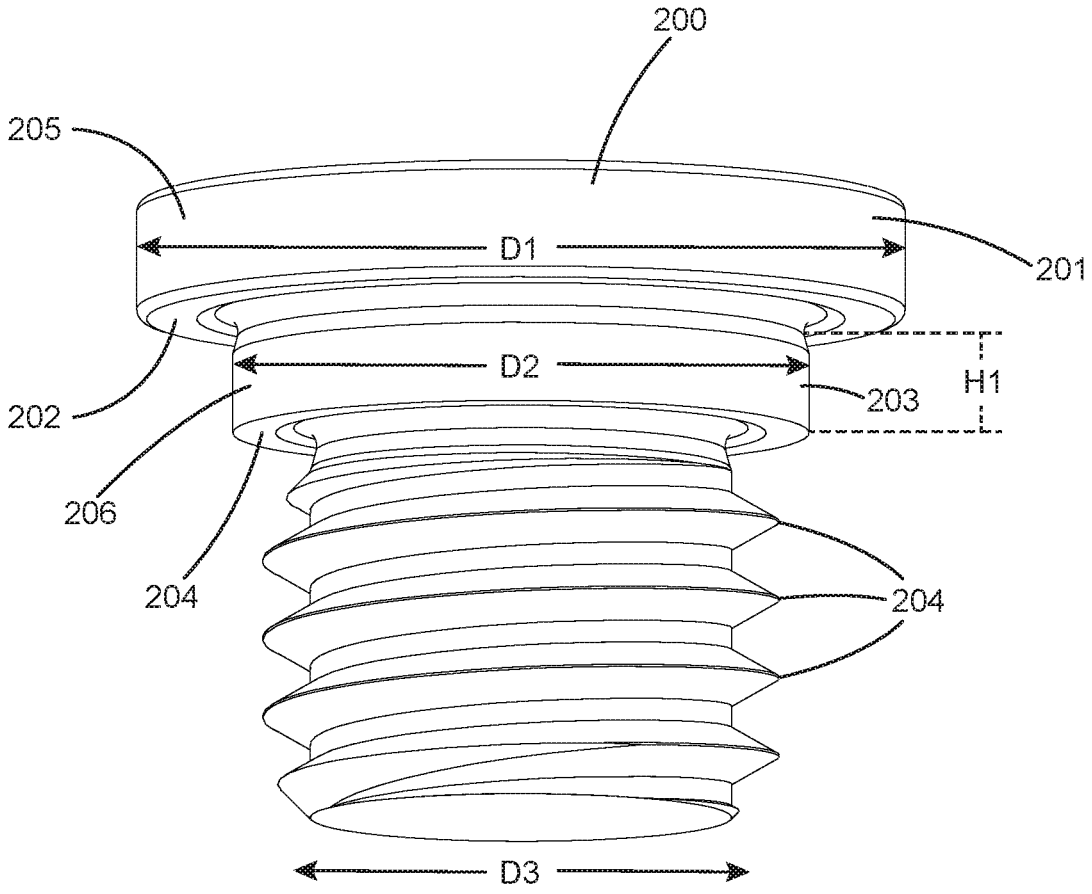
FIG. 3 is a perspective view of a T-slot threaded fastener of FIG. 1 in accordance with one example embodiment of the disclosure.

T-slot threaded fasteners 200 can be threadably coupled to one or more of the firearm receiver threaded apertures 401. In one example, a first T-slot threaded fastener is threadably coupled to the firearm receiver threaded aperture 401*b* and a second T-slot threaded fastener 200 is threadably coupled to the firearm receiver threaded aperture 401*c*. In certain example embodiments, the T-slot threaded fastener 200 can be a screw, bolt, or any other threaded rod. FIG. 3 is a perspective view of a T-slot threaded fastener 200 of FIG. 1 in accordance with one example embodiment of the disclosure. Referring now to FIGS. 1 and 3, the T-slot threaded fastener 200 can include a screw head 205, multiple screw threads 207, a shoulder stop 206 positioned between the screw head 205 and the screw threads 207.

The screw head 205 can have a generally annular shape and can include a drive aperture (not shown) configured to receive a screw driver therein. The drive aperture can be slotted, Phillips head, square head shaped, hex head shaped or any other shape of drive aperture known to those or ordinary skill in the art. The screw head 205 can also include a head side wall 201 provided along the outer radial surface of the screw head 205 and a head underside wall 202 provided along a portion of the bottom surface of the screw head 205. In one example, the head underside wall 202 can extend radially inward from the head side wall 201. The head underside wall 202 can include a flat or substantially flat bottom surface facing towards the screw threads 207. The screw head 205 can be cylindrical or substantially cylindrically-shaped and have a diameter D1 defined by the outer surface of the head side wall 201.

The shoulder stop 206 can be positioned along the shank of the T-slot threaded fastener 200 and positioned generally below the screw head 205. The shoulder stop 206 can have a generally annular shape and can include a shoulder side wall 203 provided along the outer radial surface of the shoulder stop 206 and a shoulder underside wall 204 provided along a portion of the bottom surface of the shoulder stop 206. In one example, the shoulder underside wall 204 can extend radially inward from the shoulder side wall 203. The shoulder underside wall 204 can include a flat or substantially flat bottom surface facing towards the screw threads 207 and configured to abut at least a portion of the firearm receiver 400 when threadably coupled to one of the firearm receiver threaded apertures 401*b*, 401*c*. The shoulder side wall 203 can have a height H1. The height H1 can be configurable and provides a gap (e.g., a gap having a distance greater than H1) between the top side 402 of the firearm receiver 400 and the head underside wall 202 when the T-slot threaded fastener 200 is threadably coupled to the firearm receiver threaded aperture 401. The screw head 205 can be cylindrical or substantially cylindrically-shaped and have a diameter D2 defined by the outer surface of the shoulder side wall 203. In one example, the diameter D1 is greater than the diameter D2. The screw threads 207 can generally be provided below the shoulder underside wall 204 and can be any type of screw threads known to those of ordinary skill in the art. The screw threads 207 can have an outer diameter D3 that is less than the diameter D2 and the diameter D1.

Figure 2:
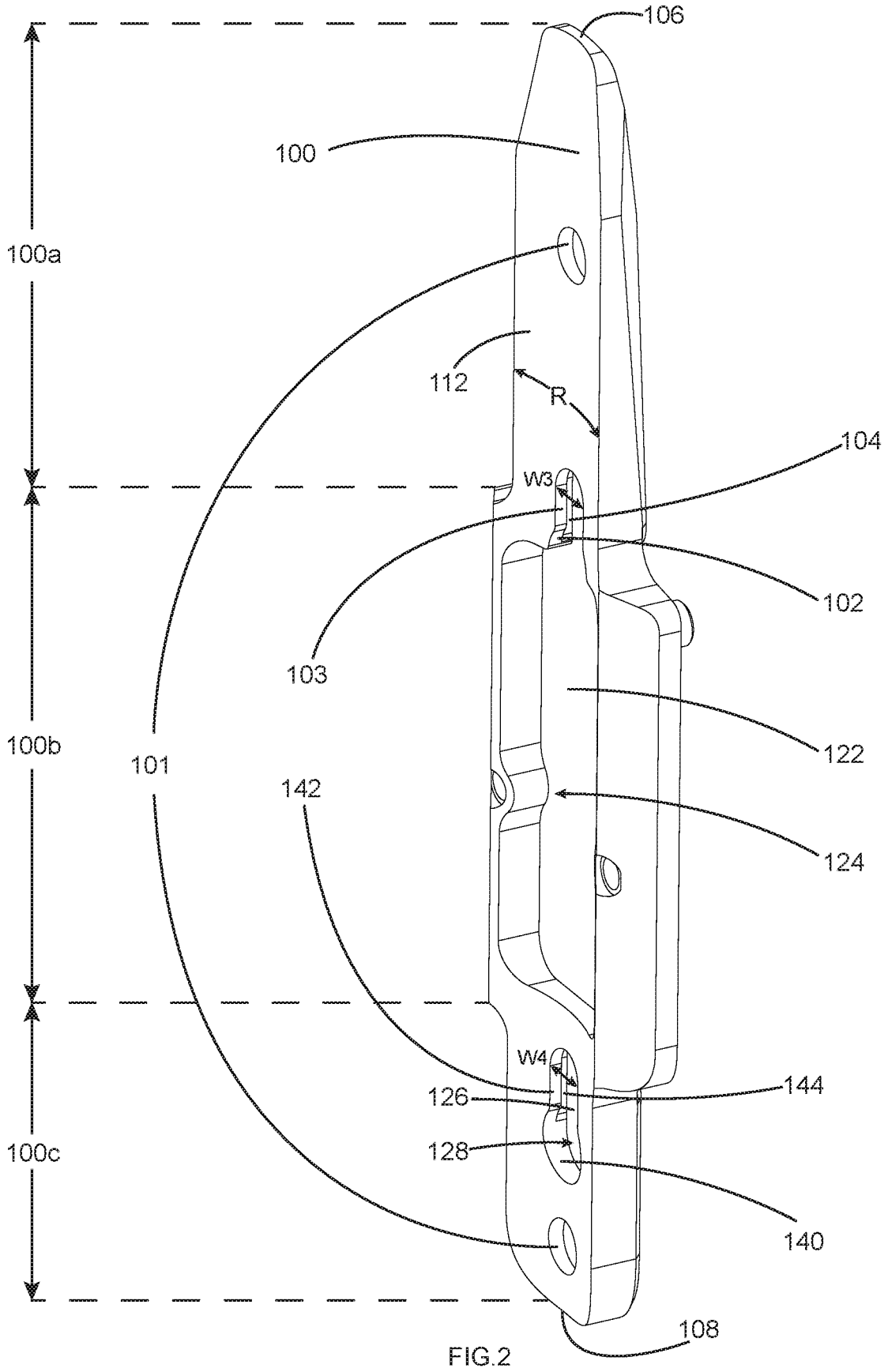
FIG. 2 is a bottom perspective view of a firearm accessory mount of FIG. 1 for mounting a firearm accessory to the firearm in accordance with one example embodiment of the disclosure.

Returning to FIG. 1, the firearm accessory mounting system can also include a firearm accessory mount 100 (also referred to as a firearm accessory mounting member 100). FIG. 2 is a bottom perspective view of a firearm accessory mount of FIG. 1 for mounting a firearm accessory to the firearm in accordance with one example embodiment of the disclosure. Referring now to FIGS. 1 and 2, the example firearm accessory mount 100 can include a first or front end 106 configured to be positioned towards the front of the firearm and a distal second or back end 108 configured to be positioned generally more towards the back of the firearm than the front end 106. The firearm accessory mount 100 can include a top side 110 and an opposing bottom side 112.

In certain example embodiments, the firearm accessory mount 100 can include three sections, a front section 100*a*, a middle section 100*b*, and a rear section 100*c*. In certain example embodiments, the width W of the front section 100*a* is less than the width of the middle section 100*b* and the width of the rear section 100*c* is less than the width of the middle section 100*b*. The top side 110 of the middle section 100*b* can be a flat or substantially flat planar surface. In addition, the top side 110 of the middle section 100*b* can be recessed with respect to the adjacent portions of the top side of the front section 100*a* and the top side 110 of the rear section 100*c*. Recessing the top side of the middle section 100*b* with the respect to the most adjacent top sides 110 of the front 100*a* and rear sections 100*b* provides a front and rear position stop that limits movement of the aiming device 500 along the longitudinal direction of the firearm receiver 400 when coupled to the firearm accessory mount 100.

The firearm accessory mount 100 can include a first through hole 101*a* positioned near the front end 106 and extending though the entirety of the firearm accessory mount 100. In one example, the first through hole 101*a* is provided in the front section 100*a* of the firearm accessory mount 100. The first through hole 101*a* can be configured to receive a first threaded fastener 114 therethrough. The first threaded fastener 114 can be threadably coupled to the first firearm receiver threaded aperture 401*a* to removably couple the firearm accessory mount 100 to the firearm receiver 400. In one example, the first threaded fastener 114 can be a screw, bolt, or any other threaded rod.

The firearm accessory mount 100 can further include a second through hole 101*b* positioned near the back end 108 and extending though the entirety of the firearm accessory mount 100. In one example, the second through hole 101*b* is provided in the rear section 100*c* of the firearm accessory mount 100. The second through hole 101*b* can be configured to receive a second threaded fastener 114 therethrough. The second threaded fastener 114 can be threadably coupled to the fourth firearm receiver threaded aperture 401*d* to removably couple the firearm accessory mount 100 to the firearm receiver 400. In one example, the second threaded fastener 114 can be a screw, bolt, or any other threaded rod.

The firearm accessory mount 100 can also include one or more mounting alignment pins 130, 132. Each mounting alignment pin 130, 132 can extend generally vertically up from the top side 110 of the firearm accessory mount. Each mounting alignment pin 130, 132 can have any shape, and, in one example, can be generally cylindrically shaped. In certain example embodiments, each mounting alignment pin 130, 132 can be positioned along the middle section 100*b* of the firearm accessory mount 100. Each mounting alignment pin 130, 132 can be configured to be received in a corresponding mounting alignment aperture (not shown) provided along a bottom side of the aiming device 500. The mounting alignment pins 130, 132 assist in accurately aligning the aiming device 500 along the firearm receiver 400. While the example embodiment of FIG. 1 shows two mounting alignment pins 130, 132, greater or fewer mounting alignment pins 130, 132 are considered within the scope and spirit of this disclosure.

The firearm accessory mount 100 can also include one or more threaded apertures 120. In one example, two threaded apertures are provided along the middle section 100*b* of the firearm accessory mount 100, but greater or less threaded apertures may be substituted for the two threaded apertures 120. Each of the threaded apertures 120 is configured to receive and be threadably coupled to a corresponding threaded fastener 501 for removably coupling an aiming device 500 to the firearm accessory mount 100. For example, the aiming device 500 can include a pair of through holes 503 for receiving therethrough a corresponding one of the threaded fasteners 501. Each of the through holes 503 can be aligned with a corresponding one of the threaded apertures 120 when the aiming device 500 is seated on the mounting alignment pins 130, 132. In one example, the threaded fastener 501 can be a screw, bolt, or any other threaded rod.

As best seen in FIG. 2, the bottom side 112 of the firearm accessory mount 100 can be curved or have a radius R. In one example the curvature or radius R of the bottom side 112 is the same or similar to the curvature or radius of the top side 402 of the firearm receiver 400. The bottom side 112 can also include a first cavity 122 provided between the bottom side 112 and the top side 110. The first cavity 122 has an opening along the bottom side 112 and is defined by one or more side walls and a top wall or roof 124. The first cavity 122 can have a depth that is greater than or equal to the distance from the shoulder underside wall 204 to the top end of the screw head 205. In one example, the first cavity 122 can be positioned along the middle section 100*b* of the firearm accessory mount 100.

The bottom side 112 also includes a first keyhole external hole 102, first keyhole external slot 103, and a first keyhole internal slot 104 in communication with the first cavity 122. The first keyhole external hole 102 provides an entry way into the first keyhole external slot 103 and first keyhole internal slot 104. In one example, the first keyhole external slot 103 is defined by one or more vertically extending side walls that extend from the bottom side 112 of the firearm accessory mount 100 towards the top side 110 but do not reach the top wall or roof 124 of the first cavity 122. The first keyhole internal slot 104 can then be provided between the one or more vertically extending side walls that define the first keyhole external slot 103 and the top wall or roof 124 of the first cavity 122.

The elongated slot portion of the first keyhole external slot 103 had a width W3 that is less than the diameter D1 of the screw head 205 but greater than the width D2 of the shoulder stop 206. The elongated slot portion of the first keyhole internal slot 104 has a width that is greater than the diameter D1 of the screw head 205. The first keyhole internal slot 104 can have a depth that is greater than or equal to the distance between the head underside wall 202 and the top side of the screw head 205. The minimum width of the first cavity 122 at any point is greater than the diameter D1 of the screw head 205. As such, the entirety of the screw head 205 can be inserted into the cavity 122 to position for insertion into the first keyhole internal slot 104 via the first keyhole external hole 102. In one example, each of the first keyhole external slot 103 and keyhole internal slot 104 are parallel to one another and co-extend along the same longitudinal axis. The first keyhole external hole 102 and first keyhole internal slot 104 are configured to slidably receive therein a portion of T-slot threaded fastener 200. For example, the screw head 205 is configured to be slidably received in and along the first keyhole internal slot 104 and the shoulder stop 206 is configured to be slidably received past the first keyhole external hole 102 and in and along the first keyhole external slot 103. Once inserted, the screw head 205 of the T-slot threaded fastener 200 is trapped between the one or more side walls defining the first keyhole external slot 103 and the top wall or roof 124 of the first cavity 122.

The bottom side 112 can also include a second cavity 126 provided between the bottom side 112 and the top side 110. The second cavity 126 has an opening along the bottom side 112 and is defined by one or more side walls and a top wall or roof 128. The second cavity 126 can have a depth that is greater than or equal to the distance from the shoulder underside wall 204 to the top end of the screw head 205. In one example, the second cavity 126 can be positioned along the rear section 100*c* of the firearm accessory mount 100.

The bottom side 112 also includes a second keyhole external hole 140, second keyhole external slot 142, and a second keyhole internal slot 144 in communication with the second cavity 126. The second keyhole external hole 140 provides an entry way into the second keyhole external slot 142 and second keyhole internal slot 144. In one example, the second keyhole external slot 142 is defined by one or more vertically extending side walls that extend from the bottom side 112 of the firearm accessory mount 100 towards the top side 110 but do not reach the top wall or roof 128 of the cavity 126. The second keyhole internal slot 144 can then be provided between the one or more vertically extending side walls that define the second keyhole external slot 142 and the top wall or roof 128 of the second cavity 126.

The elongated slot portion of the second keyhole external slot 142 has a width W4 that is less than the diameter D1 of the screw head 205 but greater than the width D2 of the shoulder stop 206. The elongated slot portion of the second keyhole internal slot 144 has a width that is greater than the diameter D1 of the screw head 205. The second keyhole internal slot 144 can have a depth that is greater than or equal to the distance between the head underside wall 202 and the top side of the screw head 205. The width or diameter of the second keyhole external hole 140 is greater than the diameter D1 of the screw head 205. As such, the entirety of the screw head 205 can be inserted into the second keyhole external hole 140 to position for insertion into the second keyhole internal slot 144. In one example, each of the second keyhole external slot 142 and second keyhole internal slot 144 are parallel to one another and co-extend along the same longitudinal axis. The second keyhole external hole 142 and second keyhole internal slot 144 are configured to slidably receive therein a portion of T-slot threaded fastener 200. For example, the screw head 205 is configured to be slidably received in and along the second keyhole internal slot 144 and the shoulder stop 206 is configured to be slidably received in and along the second keyhole external slot 142. Once inserted, the screw head 205 of the T-slot threaded fastener 200 is trapped between the one or more side walls defining the second keyhole external slot 142 and the top wall or roof 128 of the cavity 126. While the example embodiment of FIG. 2 shows two sets of elongated slots (103, 104 and 142, 144), this is for example purposes only as one or more than two sets of elongated slots (e.g., 3-10 sets of slots) could alternatively be provided along the firearm accessory mount 100.

Figure 4:
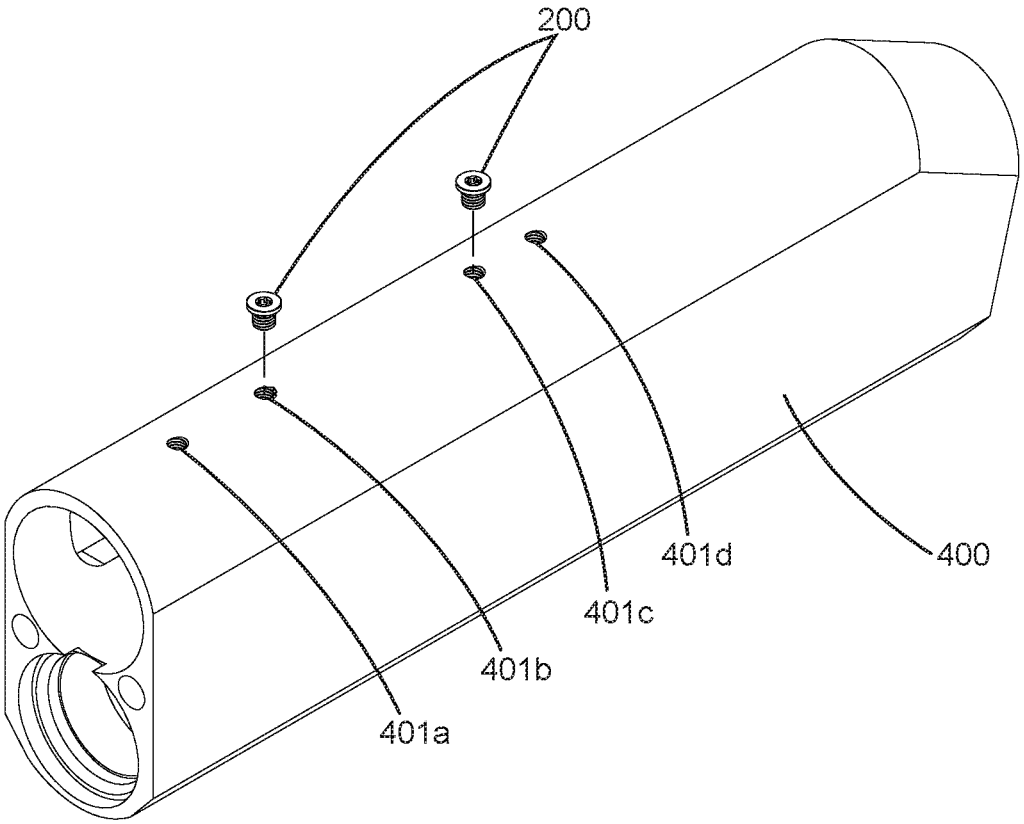
FIG. 4 is a partial perspective view of the firearm of FIG. 1, showing the coupling position of the T-slot threaded fastener to the firearm in accordance with one example embodiment of the disclosure.
Figure 5:
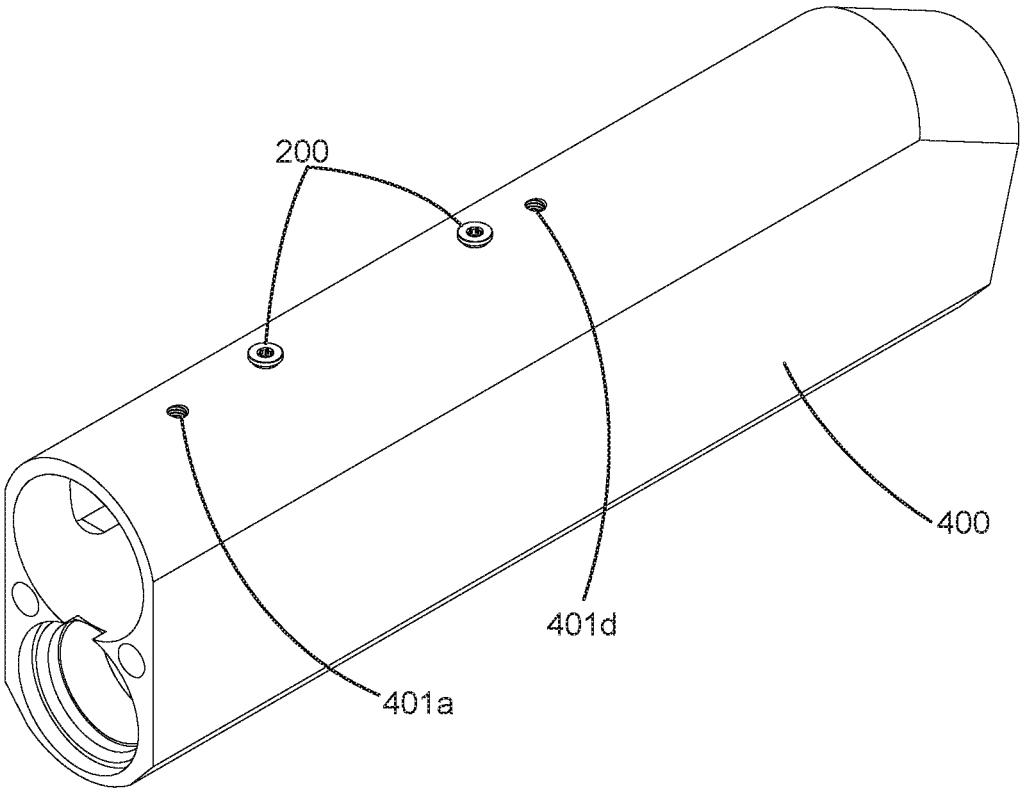
FIG. 5 is a partial perspective view of the firearm of FIG. 1, showing the T-slot threaded fasteners coupled to the firearm in accordance with one example embodiment of the disclosure.
Figure 6:
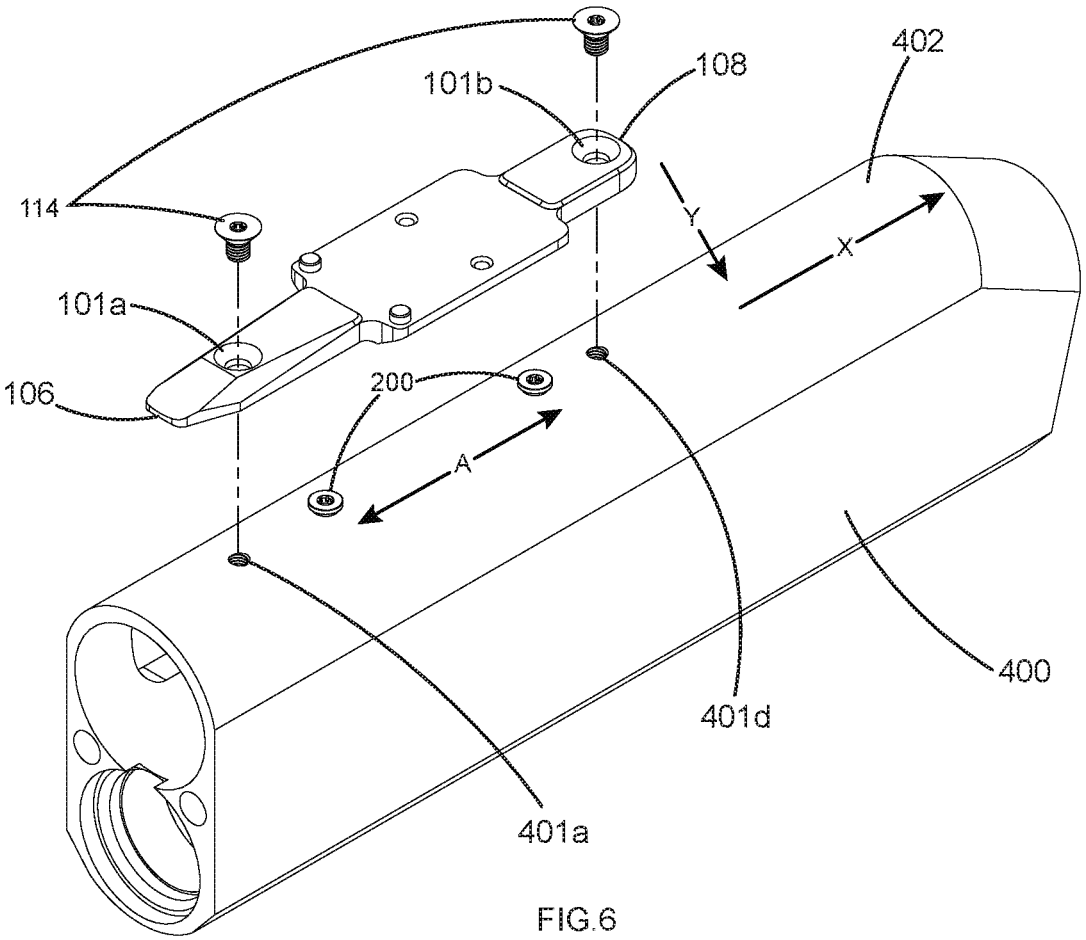
FIG. 6 is a partial perspective view of the firearm of FIG. 1, showing the initial coupling position of the firearm accessory mount in accordance with one example embodiment of the disclosure.
Figure 7:
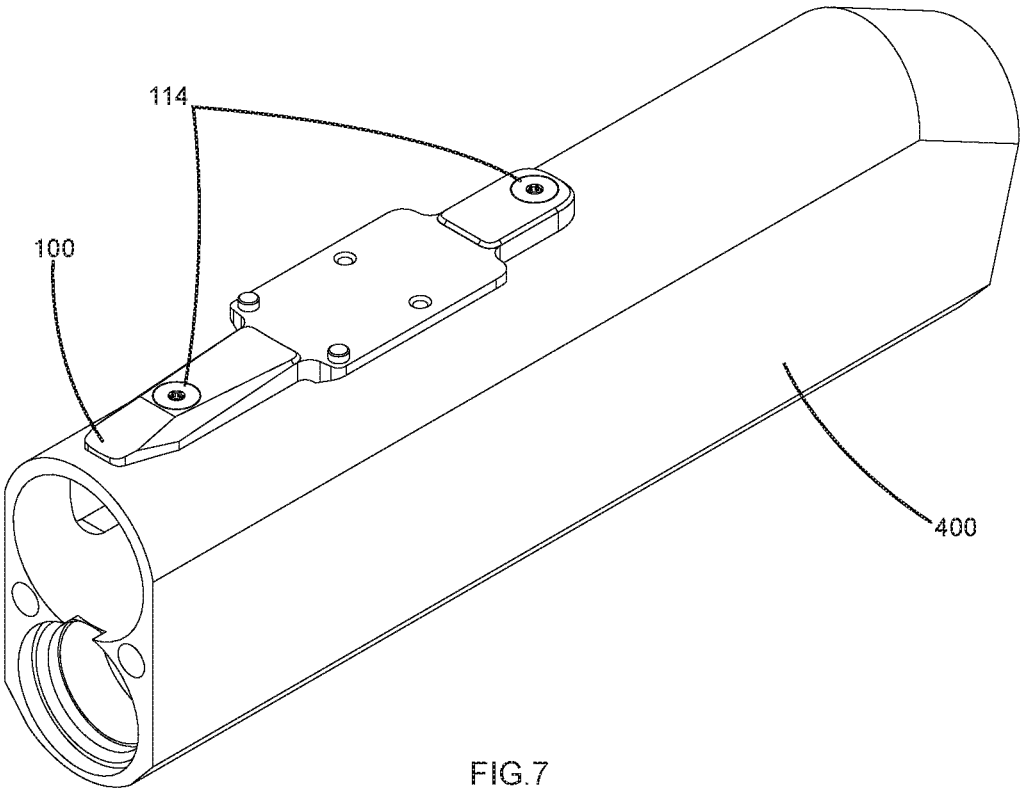
FIG. 7 is a partial perspective view of the firearm of FIG. 1, showing the firearm accessory mount coupled to the firearm in accordance with one example embodiment of the disclosure.
Figure 8:
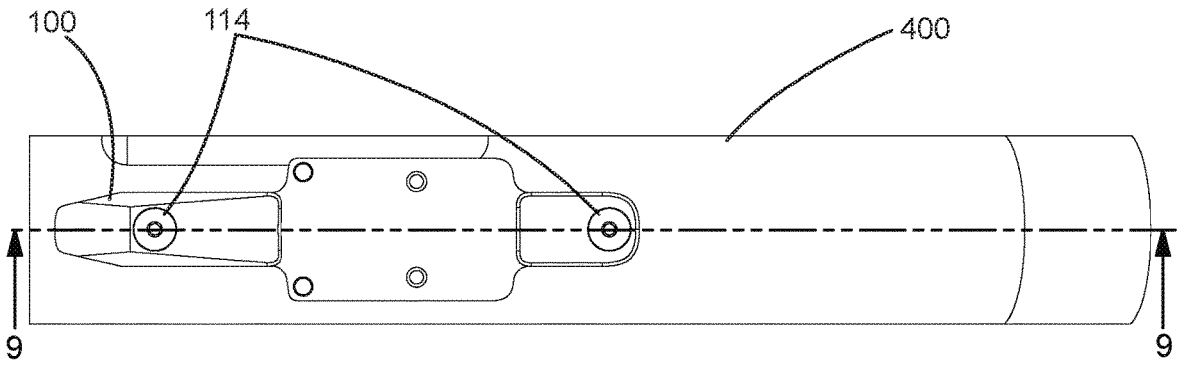
FIG. 8 is a partial top plan view of the firearm of FIG. 1, showing the firearm accessory mount coupled to the firearm in accordance with one example embodiment of the disclosure.
Figure 9:
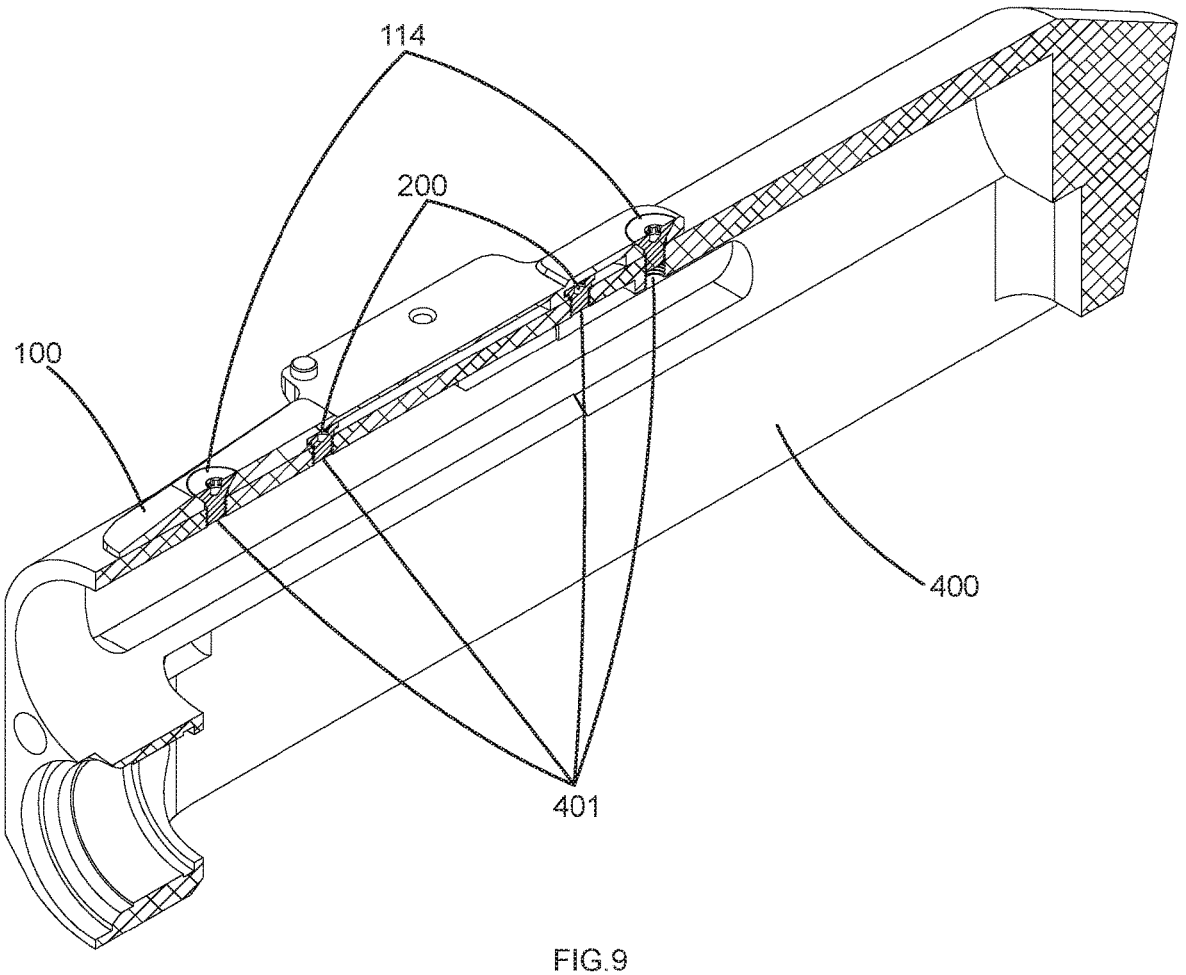
FIG. 9 is a partial cross-sectional view of the firearm of FIG. 8 taken across the plane 9-9 in accordance with one example embodiment of the disclosure.

FIGS. 4-9 and 12 provide an illustration of an example method for removably coupling a firearm accessory mount 100 and aiming device 500 to a firearm receiver 400 according to one example embodiment of the disclosure. Referring now to FIGS. 1-9 and 12, the example method begins with threadably coupling a first T-slot threaded fastener 200 into the second firearm receiver threaded aperture 401*b* and a second T-slot threaded fastener 200 into the third firearm receiver aperture 401*c* until the shoulder underside wall 204 of each T-slot threaded fastener 200 abuts the top side 402 of the firearm receiver 400, as shown in FIGS. 4 and 5.

The process can continue with the firearm accessory mount 100 being removably coupled to the T-slot threaded fasteners 200 and the firearm receiver 400, as shown in FIGS. 6-9. For example, the firearm accessory mount 100 can be lowered in the direction Y (substantially vertically downward) and the first T-slot threaded fastener 200 can be positioned in the first cavity 122 along the first keyhole external hole 102 and the second T-slot threaded fastener can be positioned in the second cavity 126 through the second keyhole external hole 140 until the bottom side 112 of the firearm accessory mount 100 is positioned adjacent to or abuts the top side 402 of the firearm receiver 400. The firearm accessory mount 100 can then be slidably adjusted along the top side 402 of the firearm receiver 400 in the direction X (substantially horizontally) (or the firearm receiver 400 can be moved in the direction opposite X) towards the back end 108 of the firearm accessory mount 100 until the first screw head 205 is positioned within the first keyhole internal slot 104 and the second screw head 205 is positioned within the second keyhole internal slot 144. In an alternate embodiment, the orientation can be reversed for each of the first keyhole external slot 103, first keyhole internal slot 104, second keyhole external slot 142, and second keyhole internal slot 144. In this alternative embodiment, the firearm accessory mount 100 can then be slidably adjusted along the top side 402 of the firearm receiver 400 in the direction opposite X (substantially horizontally) (or the firearm receiver 400 can be moved in the direction X) towards the front end 106 of the firearm accessory mount 100 until the first screw head 205 is positioned within the first keyhole internal slot 104 and the second screw head 205 is positioned within the second keyhole internal slot 144.

Figure 12:
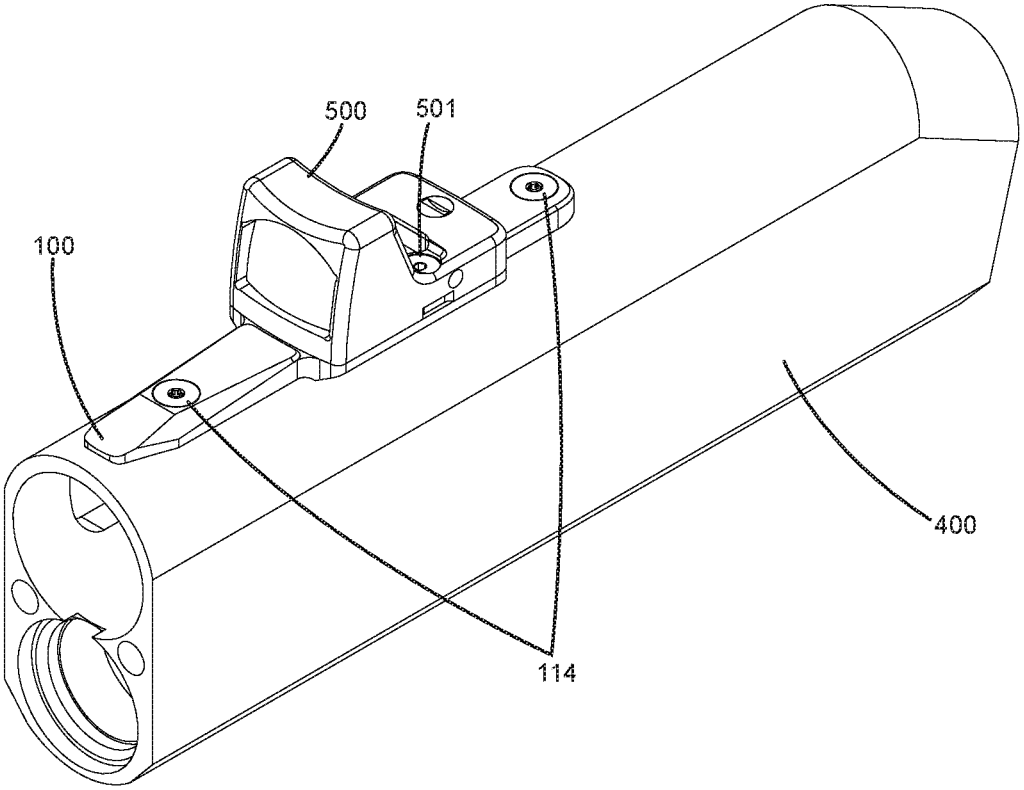
FIG. 12 is a partial perspective view of the firearm and firearm accessory mounting system of FIG. 1, showing the firearm accessory mount coupled to the firearm and the firearm accessory coupled to the firearm accessory mount in accordance with one example embodiment of the disclosure.

The first threaded fastener 114 can then be threadably coupled to the first firearm receiver threaded aperture 401*a* through the first through hole 101*a* of the firearm accessory mount 100 and the second threaded fastener 114 can be threadably coupled to the fourth firearm receiver threaded aperture 401*d* through the second through hole 101*b* of the firearm accessory mount 100 to removably couple the firearm accessory mount 100 to the top side 402 of the firearm receiver 400. As shown in FIG. 12, the aiming device 500 or any other type of firearm accessory known to those of ordinary skill in the art, may be removably coupled to the firearm accessory mount 100 by aligning the one or more mounting alignment pins 130, 132 into the corresponding receiving apertures along the bottom side of the aiming device 500 to initially position the aiming device 500 onto the firearm accessory mount 100. In addition, each threaded fastener 501 can be threadably coupled to its corresponding threaded aperture 120 along the middle section 100*b* of the firearm accessory mount 100 and through the corresponding through holes 503 in the aiming device 500 to removably couple the aiming device 500 to the firearm accessory mount 100. The process can be reversed in order to remove the aiming device 500 from the firearm accessory mount 100 and remove the firearm accessory mount 100 from the firearm receiver 400.

Figure 10:
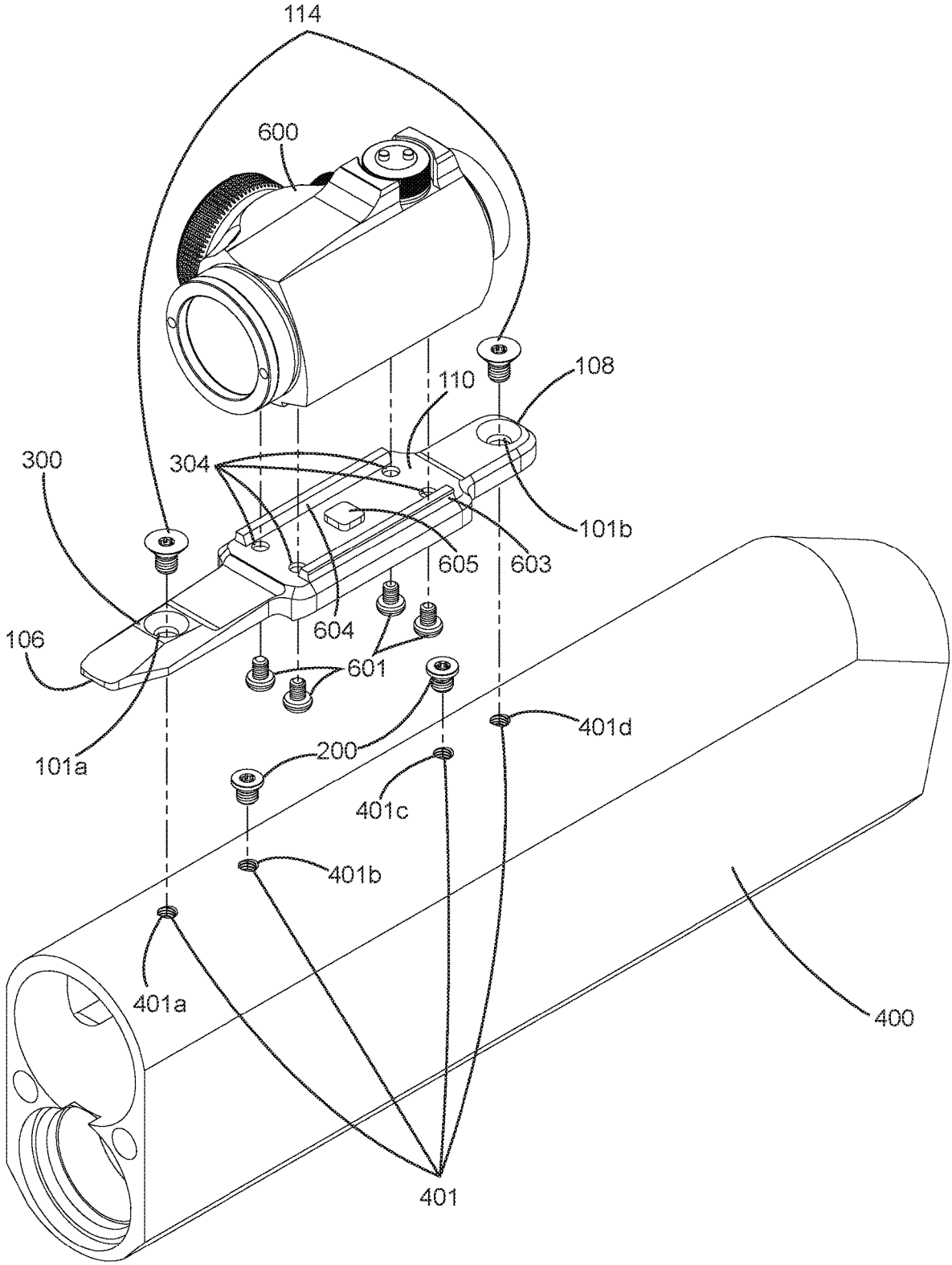
FIG. 10 is a partial exploded view of a firearm and another firearm accessory mounting system for coupling a firearm accessory to a firearm in accordance with another example embodiment of the disclosure.
Figure 11:
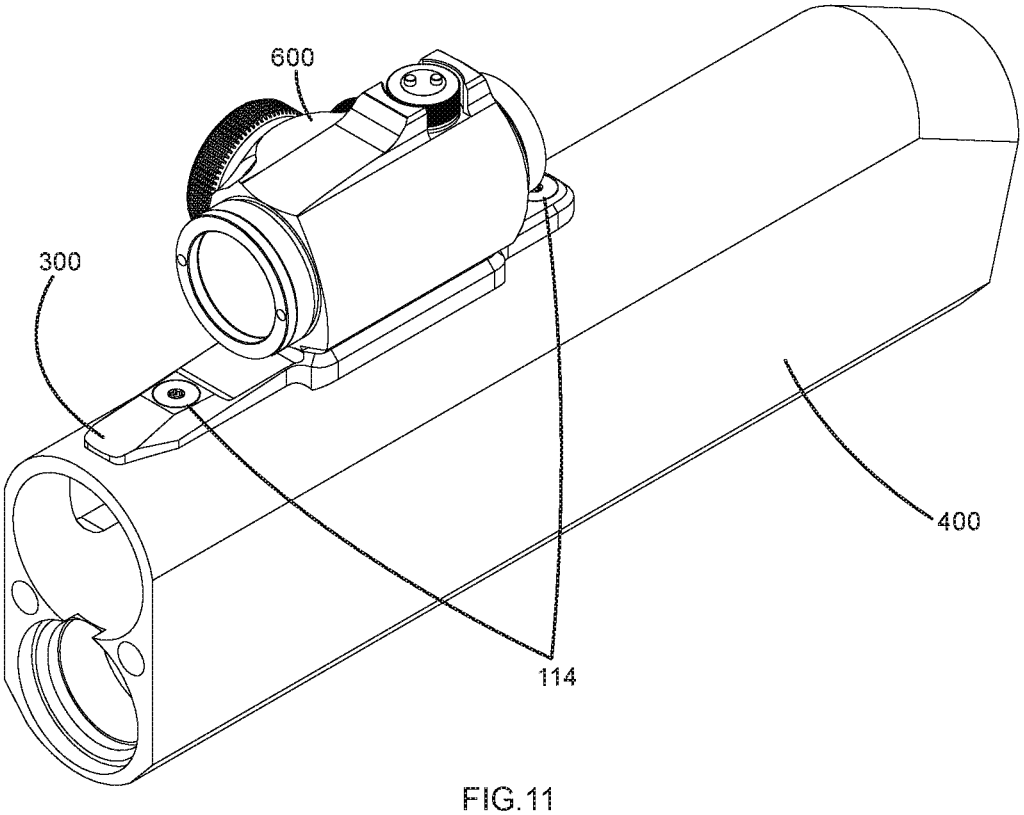
FIG. 11 is a partial perspective view of the firearm and firearm accessory mounting system of FIG. 10, showing the firearm accessory mount coupled to the firearm and the firearm accessory coupled to the firearm accessory mount in accordance with another example embodiment of the disclosure.

FIG. 10 is a partial exploded view of a firearm and another example firearm accessory mounting system for coupling a firearm accessory, such as an aiming device 600 or any other firearm accessory known to those of ordinary skill in the art, to a firearm receiver 400 in accordance with another example embodiment of the disclosure. FIG. 11 is a partial perspective view of the firearm receiver 400 and firearm accessory mounting system of FIG. 10, showing the alternative firearm accessory mount 300 coupled to the firearm receiver 400 and the firearm accessory 600, such as an aiming device, coupled to the firearm accessory mount 300 in accordance with another example embodiment of the disclosure. Now referring to FIGS. 10 and 11, the alternative firearm accessory mount 300 is similar to the firearm accessory mount 100 and contains the same features and descriptions thereof except as specifically set forth below. Accordingly, the description of the firearm accessory mount 100 and is features, as set forth above, is incorporated herein for the alternative firearm accessory mount 300 for the sake of brevity.

The differences between the firearm accessory mount 100 and the alternative firearm accessory mount 300 can include the number and positioning of the mounting alignment pin 605. For example, the firearm accessory mount 300 can include a single mounting alignment pin for aligning the aiming device 600 on the firearm accessory mount 300. The mounting alignment pin 605 can extend generally vertically up from the top side 110 of the firearm accessory mount 300. The mounting alignment pin 605 can have any shape, and, in one example, can be generally square shaped. In one example, the mounting alignment pin 605 can be substantially centrally positioned both laterally and longitudinally along the middle section 100*b* of the firearm accessory mount 300.

The alternative firearm accessory mount 300 can also include a first side rail member 603 extending along a first lateral side of the middle section 100*b* of the firearm accessory mount 300 and a second side rail member 604 extending along an opposing second lateral side of the middle section 100*b* of the firearm accessory mount 300. Each of the first side rail member 603 and the second side rail member 604 can extend vertically up from the surface of the top side 110 of the firearm accessory mount 300. In addition, each of the first side rail member 603 and the second side rail member 604 can have a length that extends along a substantial portion (e.g., greater than 50% and more preferably greater than 75% of the length) of the corresponding lateral side of the middle section 100*b* of the firearm accessory mount 300. A portion of the aiming device 600 can be configured to be placed between the first side rail member 603 and the second side rail member 604 and the first side rail member 603 and the second side rail member 604 can help properly position and limit or prevent lateral movement of the aiming device 600 or other firearm accessory until it is coupled to the firearm accessory mount 300.

The alternative firearm accessory mount 300 can also include multiple through holes 304. Each through hole 304 can be configured to receive therethrough at least a portion of a corresponding threaded fastener 601 for removably coupling the aiming device 600 to the firearm accessory mount 300. In this alternative embodiment, the aiming device 600 can be removably coupled to the firearm accessory mount 300 before the firearm accessory mount 300 is removably coupled to the firearm receiver 400 in substantially the same way as the firearm accessory mount 100 is removably coupled to the firearm receiver 400. In this alternative embodiment, each threaded fastener 601 can be threadably coupled to a corresponding threaded aperture (not shown) in the bottom side of the aiming device 600, by initially positioning each threaded fastener 601 along the bottom side 112 of the firearm accessory mount 300 and passing the threaded fastener 601 up through the firearm accessory mount 300 and into the threaded aperture of the aiming device 600 abutting the top side 110 of the firearm accessory mount 300. In one example, each threaded fastener 601 can be a screw, bolt, or any other threaded rod.

The firearm accessory mount 300 can then be slidably coupled to the T-slot threaded fasteners 200 and threadably coupled to the firearm receiver, as shown in FIG. 11, in substantially the same manner as described with respect to the firearm accessory mount 100. While the example embodiment of FIG. 10 describes four through holes 304 and four threaded fasteners 601, this is for example purposes only, as greater or fewer than four each of the through holes 304 and the threaded fasteners 601 may be substituted for that shown and described herein.

Although the firearm accessory mount features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Conditional language, such as, among others, "can," "could," "might," or "may," unless specifically stated otherwise, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A firearm accessory mount comprising:

a mounting member comprising a top side and an opposing bottom side;

a plurality of apertures extending through the mounting member; and a first cavity disposed along the bottom side of the mounting member and comprising:

a top wall positioned above the bottom side of the mounting member;

a first elongated slot defined by at least one side wall extending up from the bottom side of the mounting member;

a second elongated slot defined between the top wall and the top of the at least one side wall of the first elongated slot, the second elongated slot configured to receive therein at least a first head portion of a first threaded fastener.

2. The firearm accessory mount of claim 1, further comprising a second cavity disposed along the bottom side of the mounting member and comprising a third elongated slot, the third elongated slot configured to receive therein at least a second head portion of a second threaded fastener.

3. The firearm accessory mount of claim 2, wherein the first elongated slot has a first width transverse to a first longitudinal axis of the mounting member; and the second elongated slot has a second width transverse to the longitudinal axis of the mounting member, wherein the first width is less than the second width.

4. The firearm accessory mount of claim 2, wherein the third elongated slot and the second elongated slot are axially aligned along a longitudinal axis of the mounting member.

5. The firearm accessory mount of claim 1, wherein the bottom side is curved about an axis parallel to a longitudinal axis of the mounting member.

6. The firearm accessory mount of claim 1, wherein the mounting member comprises:

a front section having a first maximum width transverse to a longitudinal axis of the mounting member;

a rear section having a second maximum width transverse to the longitudinal axis of the mounting member; and a middle section disposed between the front section and the rear section, the middle section having a third maximum width transverse to the longitudinal axis of the mounting member, wherein the third maximum width is greater than the first maximum width and the second maximum width.

7. The firearm accessory mount of claim 6, wherein the middle section further comprises a substantially flat top side configured to receive thereon a firearm accessory.

8. The firearm accessory mount of claim 7, wherein the middle section further comprises at least one alignment pin extending up from the substantially flat top side, the at least one mounting alignment pin configured to matingly engage with a mounting alignment aperture on a firearm accessory.

9. The firearm accessory mount of claim 1, wherein the first elongated slot is configured to receive therein a second portion of the first threaded fastener different from the first head portion.

10. A firearm accessory mounting system comprising:

a firearm comprising a firearm receiver, the firearm receiver comprising a plurality of threaded apertures;

at least two T-slot threaded fasteners threadably coupled to at least a portion of the plurality of threaded apertures;

a firearm accessory mount comprising a top side and an opposing bottom side, the bottom side comprising:

a first cavity disposed along the bottom side of the mounting member and comprising:

a top wall positioned above the bottom side of the mounting member;

a first elongated slot defined by at least one side wall extending up from the bottom side of the firearm accessory mount; and a second elongated slot defined between the top wall and the top of the at least one side wall of the first elongated slot, wherein the second elongated slot is configure to receive therein a portion of a first of the at least two T-slot threaded fasteners; and a firearm accessory removably coupled to the firearm accessory mount.

11. The firearm accessory mounting system of claim 10, wherein the firearm accessory comprises an aiming device.

12. The firearm accessory mounting system of claim 10, wherein the firearm accessory mount further comprises at least one alignment pin extending up from the top side; and wherein the firearm accessory comprises at least one alignment pin aperture disposed along a bottom side of the firearm accessory, wherein each of the at least one alignment pin is configured to be received at least partially within a corresponding one of the at least one alignment pin aperture.

13. The firearm accessory mounting system of claim 10, wherein each of the at least two T-slot threaded fasteners comprises;

a screw head having a first diameter;

a plurality of screw threads having a second diameter less than the first diameter; and a shoulder stop disposed between the screw head and the plurality of screw threads, wherein the shoulder stop comprises a third diameter less than the first diameter and greater than the second diameter.

14. The firearm accessory mounting system of claim 13, wherein the first elongated slot has a first maximum width transverse to a first longitudinal axis of the mounting member; and the second elongated slot has a second maximum width transverse to the longitudinal axis of the mounting member, wherein the second maximum width is greater than the first maximum width.

15. The firearm accessory mounting system of claim 10, further comprising a second cavity disposed along the bottom side of the mounting member and comprising a third elongated slot, the third elongated slot configured to receive therein at least a second head portion of a second one of the at least two T-slot threaded fasteners, wherein the third elongated slot and the second elongated slot are axially aligned along a longitudinal axis of the firearm accessory mount and wherein the at least two T-slot threaded fasteners are axially aligned along a longitudinal axis of the firearm receiver.

16. The firearm accessory mounting system of claim 10, wherein the firearm accessory mount comprises a first through hole disposed along a first end of the firearm accessory mount and a second through hole disposed along a distal second end of the firearm accessory mount;

wherein the system further comprises:

a first threaded fastener extending through the first through hole and threadably coupled to a first one of the plurality of threaded apertures; and a second threaded fastener extending through the second through hole and threadably coupled to a second one of the plurality of threaded fasteners.

17. The firearm accessory mounting system of claim 10, wherein the firearm accessory comprises at least one through hole extending through a portion of the firearm accessory;

wherein the firearm accessory mount further comprises at least one threaded aperture;

wherein the system further comprises:

a first threaded fastener extending through a first one of the at least one through hole in the firearm accessory and threadably coupled to a first one of the at least one threaded aperture in the firearm accessory mount to removably couple the firearm accessory to the firearm accessory mount.

18. The firearm accessory mounting system of claim 10, wherein the bottom side is curved and comprises a first radius of curvature, wherein a top side of the firearm receiver comprises a second radius of curvature, and wherein the first radius of curvature is substantially equal to the second radius of curvature.

19. The firearm accessory mounting system of claim 10, wherein the firearm accessory mount comprises a plurality of through holes extending through a portion of the firearm accessory mount;

wherein the firearm accessory further comprises a second plurality of threaded apertures;

wherein the system further comprises:

a plurality of threaded fasteners, each one of the plurality of threaded fasteners extending through a corresponding one of the plurality of through holes in the firearm accessory mount and threadably coupled to a corresponding one of the second plurality of threaded apertures in the firearm accessory to removably couple the firearm accessory to the firearm accessory mount.

* * * * *